United States Patent [19]

Traütner

[11] 4,294,085

[45] Oct. 13, 1981

[54] FLAT BED KNITTING MACHINES

[75] Inventor: Johann G. Traütner, Creussen, Fed. Rep. of Germany

[73] Assignee: Bentley Alemannia Limited, Great Britain

[21] Appl. No.: 81,113

[22] Filed: Oct. 2, 1979

[30] Foreign Application Priority Data

Oct. 3, 1978 [GB] United Kingdom ..... 39031/78

[51] Int. Cl.[3] ..... D04B 7/00

[52] U.S. Cl. ..... 66/75.1

[58] Field of Search ..... 66/78, 64, 75.2, 75.1, 66/58

[56] References Cited

U.S. PATENT DOCUMENTS

| | | | |
|---|---|---|---|
| 3,605,450 | 9/1971 | Goller et al. | 66/78 |
| 3,615,145 | 10/1971 | Goller et al. | 66/78 |
| 3,693,377 | 9/1972 | Hadam | 66/78 |
| 3,955,381 | 3/1976 | Panchaud | 66/75.1 |
| 4,012,927 | 3/1977 | Kuhnert | 66/78 |
| 4,041,732 | 8/1977 | Krause | 66/75.2 |
| 4,100,767 | 7/1978 | Schieber et al. | 66/75.2 |
| 4,141,228 | 2/1979 | Schimko | 66/75.1 |
| 4,180,992 | 1/1980 | Schieber et al. | 66/75.1 |
| 4,197,722 | 4/1980 | Cote-Petit et al. | 66/75.2 |

*Primary Examiner*—Ronald Feldbaum

*Attorney, Agent, or Firm*—Robert E. Burns; Emmanuel J. Lobato; Bruce L. Adams

[57] ABSTRACT

In a flat bed knitting machine, needles are selected for tucking in either direction of traverse by jacks selected by an actuator bank, preferably electronically controlled, located below a clearing cam. The jacks may themselves carry pattern butts as means are provided in a preferred embodiment to place all jacks in the same pre-selection attitude. The jacks may operate the needles directly without intermediate jacks. The cam carriage may have transfer stations at each end for leading and trailing transfer.

25 Claims, 16 Drawing Figures

FLAT BED KNITTING MACHINES

DESCRIPTION

1. Field of Invention

This invention relates to flat-bed knitting machines with individual needle selection mechanisms and especially to automatic flat-bed knitting machines with electronic needle selection.

2. Background of Invention

The German patent Specification No. 2,222,408 (Dubied) describes an electronically controlled flat bed knitting machine capable of selectively floating (also referred to as non-knitting), tucking, knitting and transferring between the beds of the knitting machine. This task is accomplished lifting each needle individually with an auxiliary instrument activated by a magnet. One magnet is thus required for each selectively operable needle.

The German Patent Specification No. 2,445,027 (Stoll) discloses an electronically controlled flat bed machine in which needles are selected for floating, knitting and transferring by banks of electronically operable actuators disposed at an appropriate position on the cam carriage. Each bank may cause a particular one of the needles to be selected as the cam carriage passes over the needles. The arrangement cannot be used for selective tucking and intermediate jacks are necessary. Selective tucking is only possible by using high and low butts. The intermediate jacks are located between the needles and the instruments which are directly operated by the actuator banks. This increases the trick length of the needle beds employed.

Furthermore both the jack carrying pattern butts engaged by the actuator banks and the intermediate jacks have to operate sequentially in each direction of cam carriage traverse. Thus the position at which the actuator bank engages the pattern butt and that where the needle operating butt is finally shifted by the intermediate jack in an appropriate direction are spaced apart by a considerable distance, the actuator bank being under one knitting or transfer system to control section at a following knitting or transfer system.

During each traverse some intermediate jacks are left at an elevated position on the trailing side of a cam carriage to influence needles as desired during a subsequent carriage traverse in the opposite direction.

The U.S. Pat. No. 3,715,892 (Hadam) shows another type of electronically controlled flat bed knitting machine. Banks of permanent magnets whose magnetic fields can be cancelled selectively are used to select needles for tucking and floating successively. The instruments carried in each trick operate so that needles are selected by pressing a needle operating butt toward the bottom of the trick. In the absence of selection all needles will knit. The operating butt is mounted midway on a pliable actuating jack secured to the needle and supported at each end. A selector jack is operable by the banks to resiliently deform the middle portion of the actuating jack whether it is at a low float level or at a higher tuck level. Each needle is thus only subjected to a single selection for choosing float or tuck. Such an arrangement suffers from drawbacks. The instruments carried in each trick are many and of complex shape. The instruments have to be sprung towards a position ready for selection. The instruments, particularly the midway depressable actuating jack, can of necessity only be housed in a long trick, increasing the size of the needle bed and cam carriage. Furthermore four banks are necessary with each knitting system if float and tuck are to be selected in each direction of knitting. The needles selected to float or tuck may have to be reselected on leaving the knitting system to prevent the stitch cam from influencing those needles.

It is the purpose of the invention to provide an electronically controllable flat knitting machine which employs only a small number of selection stations yet can select between floating, tucking and knitting in each direction of reciprocation. It is also a purpose of the invention to provide independent individual needle selection at successive knitting systems in a multi-knitting system cam carriage. It is another purpose of the invention to ensure that once a selection has been performed, subsequent operations occur reliably and, if required, without spring bias for returning instruments to a selection position. It is also the purpose of the invention to reduce the number of instruments in each trick and the length of the tricks.

In the prior art specifications various means have been proposed for transferring between the beds of the knitting machine. Frequently the transfer sections are arranged so that the transfer the possibilities are limited or separate cam carriage traverses are required to specifically re-arrange the last knitted course between the respective needle beds prior to knitting a subsequent course, so reducing productivity.

The West-German Patentschrift No. 1,785,099 describes a transfer system using a transferring cam having fixed peaks for spreading and then transferring loops and receiving cams for raising needles to receive loops. In one embodiment auxiliary jacks are used to lift main jacks onto a receiving cam acting on jack butts to indirectly lift the needles for receiving loops. Selective transfer is thus effected in each direction of cam carriage traverse. A number of independent selections is required ahead of the transfer system (i.e. on the leading side thereof in the direction of cam carriage movement) so as to separate the auxiliary jack butts for selectively raising of needles to receive loops and so as to separate the main jack butts for selecting needles to transfer loops.

The aforesaid transfer system will thus require auxiliary jacks in addition to main jacks and a considerable number of auxiliary and main jack selection systems.

It is therefore another purpose of the invention to provide an electronically controllable flat knitting machine capable of high productivity, of transferring selectively under electronic control using few additional selection stations. It is also a purpose of the invention to provide a cam system which does not require resetting of the insertion of bolt cams to varying extents between successive traverses and which is capable of allowing the necessary selection with a constant needle operating butt height. It is another purpose to provide a knitting machine in which both the needles to be selected and the purpose of their selection can be read from a single programme. It is another object of the invention to provide a cam carriage of simple construction capable of leading and trailing transfer with only one selection system and utilising a single set of jacks.

DESCRIPTION OF INVENTION

The invention utilises a simplified arrangement for the cam carriage and the instruments carried in the tricks whereby the actuating position and the position of the consequential shift of the needle operating butt from one track to another, can be spaced closely together. The needle operating butt may be part of the needle proper or fastened to an element coupled to the needle.

Thus in a first aspect of the invention the close actuating-needle butt shift spacing is used to provide a flat bed knitting machine having needles and jacks individually associated with one another in tricks of needle bed, and a carriage mounting actuator banks and cams for selectively operating the jacks and needles as the carriage traverses across the needle bed in which first selected needle operating butts are raised by the associated jacks first from a collecting track for knitting and then second selected needle operating butts are raised by the associated jacks subsequently from the collecting track for tucking by cam means and by a bank of actuators for selectively engaging the jacks which bank is located spaced in the direction of the tricks from a clearing cam, and which cam means is arranged to raise the needle operating butts on the trailing side of the clearing cam in each direction of traverse. The cam means generally include cams for raising the jacks.

In a second aspect of the invention the spacing between an initial actuating and the subsequent consequential needle butt shift is decreased by a combination of one or more of the following features. Preferably the needle and its operating butt cooperate with only a single separate and independantly moving jack. It has been found surprisingly that the jacks can be actuated, if necessary held in position, and lifted to raise the needle operating and subsequently lowered to an actuating level over a distance sufficiently small to permit all the jacks to be brought back quickly to the actuating level after a knit selection or a subsequent tuck selection for subsequent actuation.

The raising of the jacks is instrumental in imparting motion to the needles to various extents.

Preferably the jack raising cam means are operative to raise the needle operating butts to tuck level and into the path of the clearing cam. The cam means then advantageously include cam means which are projectable and withdrawable and substantially contiguous with the clearing cam to prevent undesired lowering of needle operating butts on the leading side of the clearing cam by being projected and to permit raising of the needle operating butts to tuck level on the trailing side in each direction of traverse. Thus the upward needle movement up to tuck level is controlled entirely by the jack raising cams whilst the needles and jacks are lowered separately with the jacks lowered slightly in advance of the needles. The cam system remains simple whilst providing secure operation. Alternatively the jack raising cam means are operable to raise the needle operating butts into the path or over the top of a needle raising cam which in turn raises the needle operating butts into or locates the butts in the path of a clearing cam and the needle raising cam is spaced from the clearing cam to permit raising of the needle operating butts to tuck level on the trailing side of the clearing cam. The needle raising cams then present inclined, spaced tuck cam slopes located on either side of the clearing cam and above the collecting track which finally only retain the needle operating butts of inactive needles. Thus a cam track is provided between the clearing cam and the tuck cam slopes to permit selected needle operating butts to rise to tuck level on the tuck cam slopes. Conveniently a guard cam is provided between the clearing cam and the tuck cam slopes to prevent needle operating butts from moving downward through this cam track. The bank of actuators is located generally below the clearing cam for controlling the jacks' attitude and is effectively located between the jack raising cams operating in each traverse direction so as to cause selected jacks to be placed in an active attitude, engage the appropriate raising cam to shift the associated needle operating butt out of the collecting track.

The actuator banks are advantageously controlled by an electronic patterning control system. The actuators may be of the cancelling, permanent magnet type or rely on actuator cams operated magnetically to mechanically push pattern butts into the tricks. The jack configuration may be selected to conform with the actuators.

The jack configuration may be of a spring tailed jack type but is preferably for reasons which will become clear of a rocking jack type. In any event, they are movable between two attitudes, one in which they will elevate a needle (called the active attitude) and one in which they will not elevate a needle (called the inactive attitude). The movement may be cam induced in each sense, or the jacks may be biassed towards one attitude by springs as is the case with actuators of cancelling, permanent magnet type. The selection effected by the actuators may be the result of selective movement of jacks in the inactive attitude to the active attude or vice-versa. For the sake of clarity, the terminology herein used is that appropriate to that for rocking jacks actuated into the active attitude. Naturally other modes of operation can also be adopted in modifications of the invention.

The collecting track extends through the length of the knitting cam system. The collecting track guides the needle operating butts without deformation of any element retained in the trick. To achieve tuck selection, the needle operating butt is merely raised upward from an inactive level without any preceding lifting of the needle earlier in the knitting cam system. Thus surprisingly the invention enables similar selection arrangement to be adopted at other places in the cam carriage where needle operating butts have also to be raised out of the collecting track but in order to achieve, say, knitting or transfer. The tuck selection is made on inactive needles at the time of clearing the loops on other active needles.

The fact that all individual selections can be made from the inactive level whilst the needle operating butts are in the collecting track removes the need to provide firstly a common selection level whilst secondly permitting needle operating butts to be selectively displaced at different levels say from a low level to tuck as well as from a tuck level to clear. This requirement was normally met with the aid of intermediate jacks which are nudged by pattern jacks (after the latter have been selected at the common selection level) and then can travel upward to displace the needles at whatever desired level without requiring the pattern jacks to move in a corresponding manner. In a further development of the invention therefore the jacks are rockable to place them in the active or inactive attitude at a selection level, the jack raising cams are arranged with respect to the respective tuck cam slopes so that the jacks shift the needle operating butts directly (i.e. without the intervention of intermediate instruments) above the collecting track, and jack lowering cams are provided to return the jacks to the selection level. The jacks may be rocked by presser instruments carried in the tricks at a fixed height but in a preferred and simple construction the jacks themselves carry a pattern butt at an appropriate level for direct operation by one the actuators to place the selected jacks in the active attitude, and means are provided adjacent the actuator banks for operating on the jacks at the selection level and place all jacks in the inactive attitude prior to selection. The aforesaid means may be a simple shiftable presser cam which can be appropriately located in either direction of traverse. Its shifting places the presser cam firstly upstream of the actuators and secondly avoids operation of the jacks subsequent to their selection.

In a preferred construction the presser cam has two elements. A first element engages a butt at a small radius with respect to the rocking jack pivot to quickly rock the jack through the major part of its movement and a second element engages the rocking jack at a large radius using more shallow cam profile so as to locate the rocking jacks in the pre-actuation position in a reliable and accurate manner.

The jacks operate directly to shift the needle operating butts and thus may have to engage needles at different levels sometimes slightly below the theoretical collecting track. Once the needles have been engaged, they must be lifted securely to ensure that the needle operating butt is lifted to the required exent and remains lifted with the appropriate butt projected for leading selection at a subsequent traverse and to resist unintended lowering. Advantageously therefore the jacks are shaped so as to hold them in the active attitude when raised. This condition cannot be satisfied with spring tailed jacks which tend to return to their original relaxed position as soon as the cam carriage has passed. Similarly it is desirable that inactive jacks are not accidentally rocked in operation. Preferably then a magnetic strip is provided on the needle bed for holding the jacks releasably in the inactive attitude. Conveniently the magnetic strip is of a permanent magnetic material which is shielded and acts on the lower ends only when the jacks are lowered. The shielding may be done by a plastics material. The magnetic attraction can also be used to hold the jacks permanently out of action (i.e. without requiring any operation of the selection system whatever) by extra lowering of the jacks by hand.

The selecting arrangement detailed previously can be employed advantageously for bi-directional operation with a plurality of knitting cam systems and transfer cam systems. Thus each actuator bank may be used to select in each direction of carriage traverse to provide full knit, tuck, float and transfer selection. Bolt cams which are re-set between successive traverses for giving tuck stitches can be avoided, simplifying the cam carriage construction.

The overall cam carriage may provide two adjacent knitting systems flanked by a transfer system on each side or two knitting systems spaced by a transfer system or two knitting systems spaced by a first transfer system, the whole being flanked by two further transfer systems.

When all individual needle selections are made in the same way as the tuck selection, simple and direct control of the needles can be exercised. Knit and tuck selection are independent and no needle undergoes more than one selection at a particular yarn fedd, yet deformable jacks etc. are not needed. The cams on the cam carriage can be fixed for the duration of selective knitting and need not allow passage of the needle operating butts past the clearing cam at tuck height.

Thus it is possible to program the whole knitting operation from a common source in the form of, for example, a tape. Preferably a selecting means is programmed through punched tape for selecting both the needles to be selected and the type of selection i.e. the kind of stitch to be formed by the selected needles.

DESCRIPTION OF EMBODIMENT OF INVENTION

General

Figure 1:
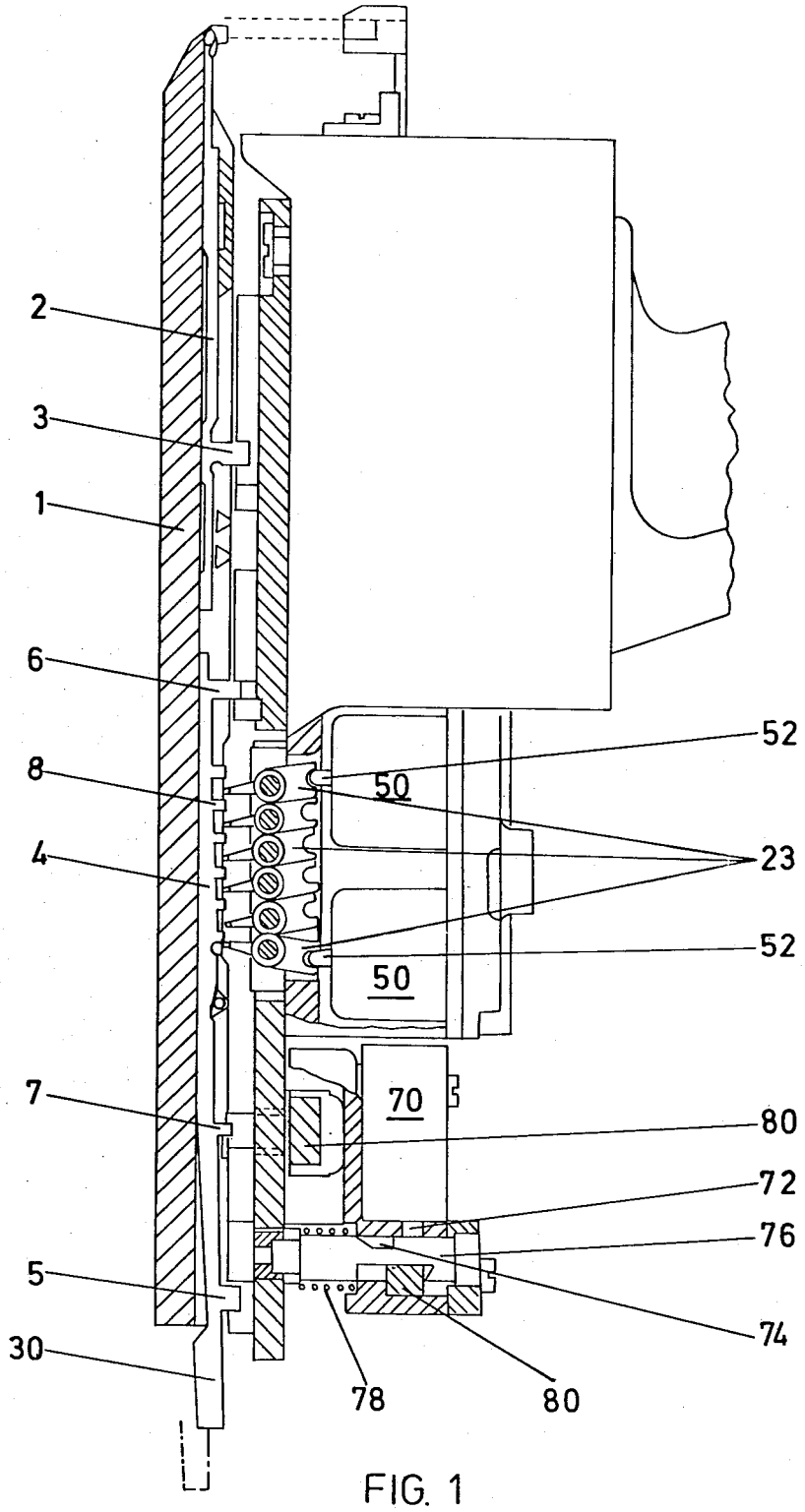
FIG. 1 shows a section of cam carriage and needle bed assembly of a flat bed knitting machine according to the invention.

With reference to FIGS. 1 to 5, a V-bed flat machine has a yarn supply and a fabric take down mechanism for cooperating with a cam carriage for traversing over a pair of needle beds 1. FIG. 1 illustrates one needle bed and one cam box of the cam carriage. Another cam box is analogously arranged for the other needle bed. Each cam box has retractable cams which are reset by slides as appropriate. In this case each cam box (see FIGS. 2 and 3) has a pair of transfer sections shown at B (FIG. 3) with between them a pair of knitting sections shown at A in FIG. 2. The cam box is thus a two-system bar similar to that shown in FIG. 5.

Figure 4:
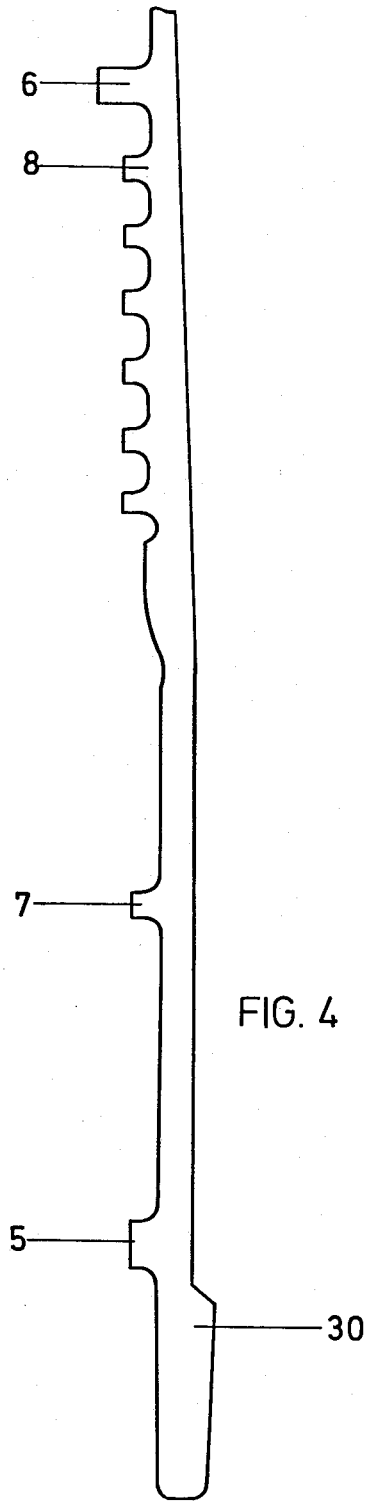
FIG. 4 shows enlarged a rocking jack for the needle bed assembly of FIG. 1.

The tricks in the needle beds contain needles 2 with butts 3 and rocking jack 4 shown enlarged in FIG. 4 with operating butts 5 and 6, one at each end, presser cam butts 7 and one pattern butt 8 arranged at one of six different levels in the usual echelon formation. In FIGS. 1 and 4 all butts 8 are shown but appropriate butts are broken off to leave one butt 8 per jack.

Knitting cam sections for needle operating butts

Figure 2:
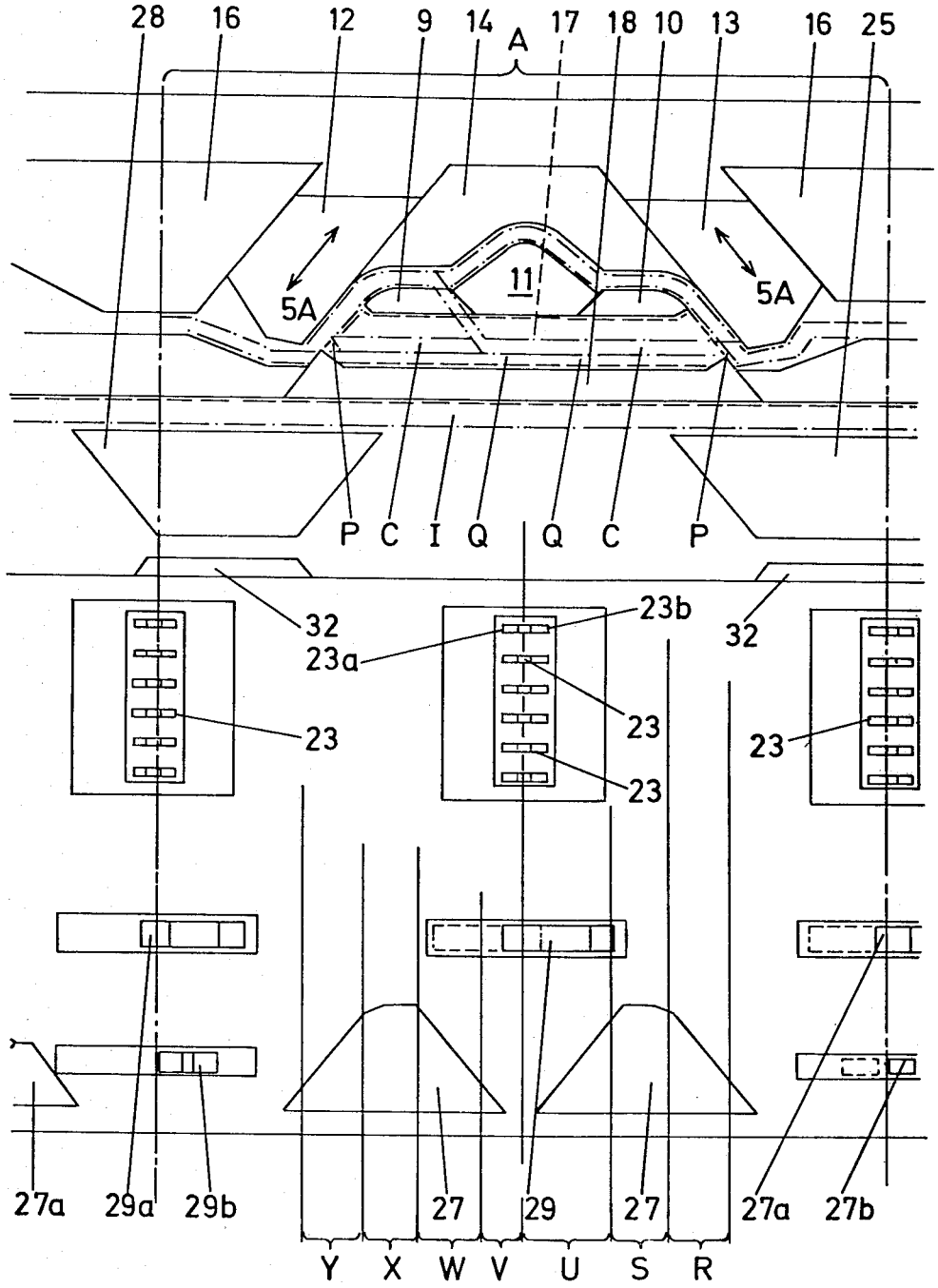
FIG. 2 shows an inside view of a knitting system of the cam carriage of FIG. 1.
Figure 3:
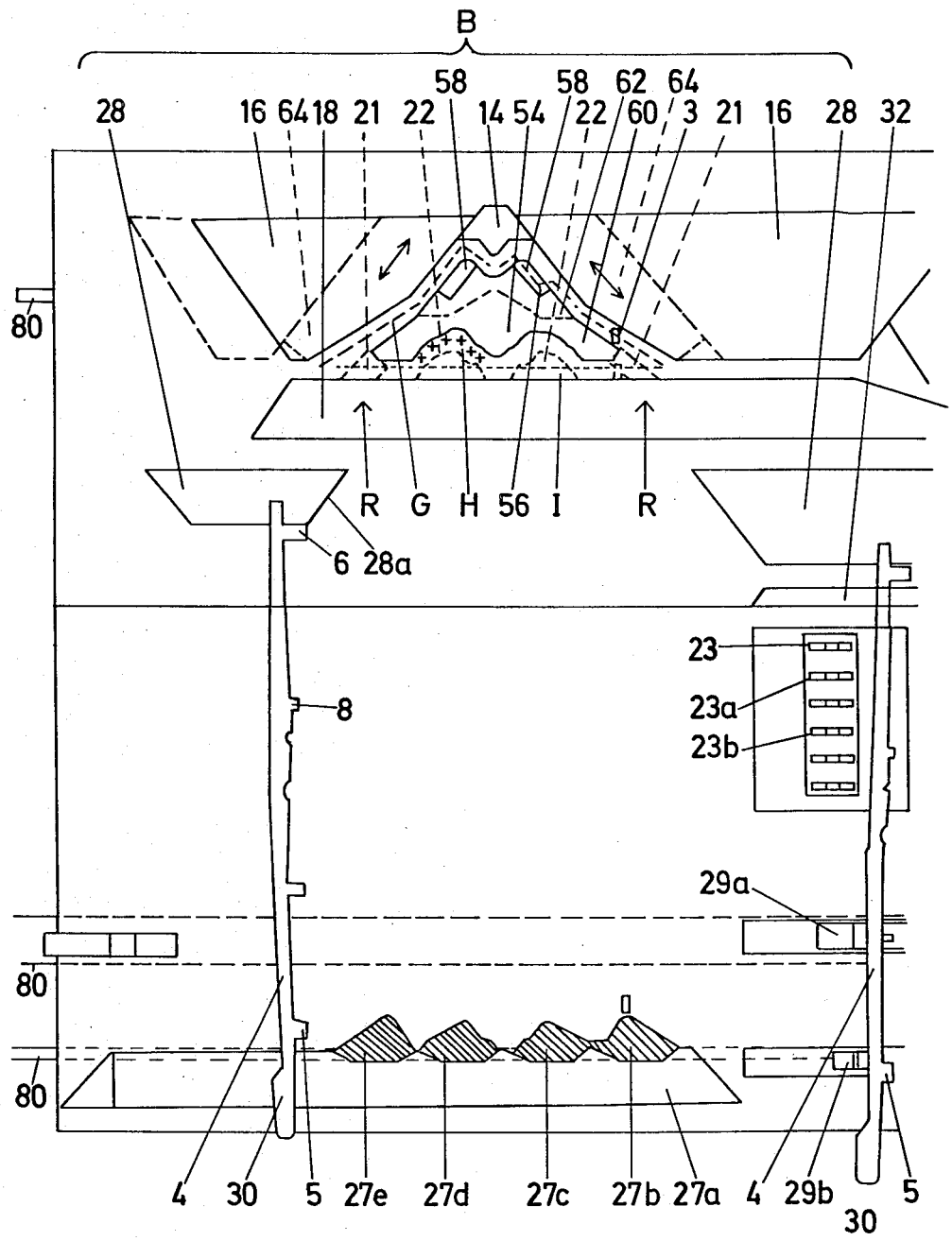
FIG. 3 shows a inside view of a transfer system of the cam carriage of FIG. 1.

The knitting sections A are similar and each provided with four different needle butt paths or tracks: a knitting track; a tucking track a float or non-knit track which is part of a collection track C best seen in FIGS. 2 and 3 and a low inactive track I. The needles whose butts are in the low inactive track I do not participate in knitting at any stage and have their lower jacks ends at the position shown in chain-dotted lines in FIG. 1.

These tracks are available in either direction of traverse and are defined by the cams described in the following. Each knitting section has a pair of cams 9, 10 for defining above them a tuck level, a central clearing cam 11 for lifting the needles previously raised to tuck level to clearing height and a pair of stitch cams 12, 13 (adjustable in the direction of arrow SA in FIG. 2) for lowering the needles which have passed over the clearing cam to draw the yarn loops. Various guard cams 14, 16, 18, are provided. The cams 9, 10 each are retractable and one of them is retracted when knitting selectively.

Below the cams 9, 10 there may be a retractable raising cam 17 (shown in dotted lines in FIG. 2). This can be used for non-selective knitting during which both cams 9 and 10 are projected. In each direction of traverse during selective knitting, needle butts at a float level in the collecting track may be raised selectively, as will be described, at two positions: at P in front of the leading cams 9 and 10 to select for knit or at Q in front of the trailing cam 9 or 10 under the clearing cam to select for tuck.

With reference to FIG. 2, it can be seen how in one direction of traverse the chain dotted path of the needle butts 3 diverges at P to select for knit and similarly later at Q to select for tuck.

The yarn is taken by the needles when their butts are over the trailing cam 9 or 10.

Transfer cam sections for needle operating butts

The transfer sections B each provide 3 alternative needle butt tracks:

G shown at———in FIG. 3 for transferring loops from the needles concerned;

H shown at+++in FIG. 3 for receiving loops onto the needles concerned; and

I shown at . . . in FIG. 3 for allowing butts to pass unaffected.

The tracks are defined by the various cams shown in FIG. 3. FIG. 3 shows retractable cams shaded. In each direction of traverse, selection is only possible at position R in FIG. 3 in front of the trailing transfer section B. Selection for a leading transfer section can however be made during a preceding tranverse as will be explained. Special cams may be provided for non-selective transfer. Such cams are shown at 21, 22 and are projected to cause all needle operating butts to be raised for transfer in one needle bed, whilst the other needle operating butts are raised slightly for loop reception. The needles have loop spreading clips to enable loops to be transferred without any racking of the needle beds.

Selection section for jacks

The cam boxes have mounted on them, a selection section containing five selection stations for the rocking jacks 4, including cams for coacting with the operating butts to raise or lower the jacks 4 and actuator cams and other presser-type cams for rocking the jacks 4.

The actuators or rockers 23 are arranged in banks of six and have a pair of inclined faces 23*a* and 23*b* (FIGS. 2, 3) for coacting with the pattern butts 8 at the corresponding levels. Five such banks are provided, one centrally between the two knitting sections A, one under each of the clearing cams 11 of the respective sections A, and one each between adjacent pairs of knitting sections A and transfer sections B. Each bank of rockers 23 is controlled by six solenoids 50 having a coil with a pivotable armature 52 and a permanent magnet to bias the armature in one sense. Energisation of the coils pivot the appropriate rockers through the dead centre position into the path of the pattern butts 8. On de-energisation the permanent magnet assisted if necessary by a reverse current flow, moves the rockers 23 out of the path of the pattern butts 8. The rockers 23 are arranged in front of their pivot point and move through the dead-centre position on actuation. Thus when a jack butt 8 strikes a rocker 23, the resultant force pushes the appropriate armature 52 further away from the dead centre position against an abutment so ensuring a safe selection.

When the rocker 23 engages a butt 8, it rocks the jack concerned so that the lower operating butt 5, called the lifting butt, moves out of the needle bed ready for engagement by one of the lifting cams 27, shown at the bottom of the selection section in FIGS. 2 and 3. The cam carriage has four lifting cams 27 provided, one between each of the banks of actuators cams. The lifting cams 27 for the transfer sections B have each a fixed lower part 27*a* and retractable upper parts 27*b, c, d, e.* The lifting cams 27 serve to lift the rocking jacks 4 at positions P, Q and R in either direction of traverse to cause the needle butts to knit if selected early, tuck if selected late at either of the knitting sections A or to select for transfer at the transfer sections B.

The cams 27 for the selection of the knitting sections A are in one piece and non-retractable. After lifting, one of the lowering cam faces 28*a* provided by cams 28 engages the other operating butt 6 to lower any jacks previously lifted. Plates 32 may be provided under the cams 28 to prevent excessive lowering of the butts 6 and ensure all jacks are properly aligned for selection. The jacks are then rocked back to their starting position by angularly tipped presser cams 29 (see FIGS. 1 and 2) which can be shifted to place them just upstream of the next bank of actuator cams 23 in either direction of traverse. The presser cams 29 may have a first element 29 a operating a small distance from the jack pivot to return the jacks initially in a quick manner and a second element 29 b operating on the lifting butts to push them securely into the tricks and ensure that the pattern butts 8 are appropriately arranged for selection. The jacks are held in the rocked position, when lifted, by a thickened end part 30. The jacks may be held in the rocked back position, once lowered, by a magnetic strip which attracts the thickened end part 30, but preferably this is omitted when the presser elements 29*b* are incorporated.

Operation for knitting sections

With reference to FIG. 2, the overall operation for selective knitting is thus as follows. When moving the carriage from left to right, the different butts enter the cam carriage cam sections from the right.

In zone R, needles previously selected to knit are engaged from below by jacks 4 in the active attitude whose lifting butts 5 have been placed on the lifting cams 27. In-active jacks pass by the cam 27 without being disturbed. The jacks could start to engage the needles at a variety of levels depending on the stitch cam position.

The jacks 4 may raise the needles until the needle operating butts follow a horizontal path above the cam 10. The needle operating butts 3 of the needles selected for knitting are thus guided to above the cam 10 which is projected. The cam 10 thus holds the needle operating butts at the levels suitable for engaging the clearing cam 11 without assistance of the jacks 4.

In zone S, the jacks in the active attitude commence to travel horizontally. They continue to do so until zone Y is reached. The needles selected to knit now are lifted by the clearing cam 11 whilst the butts of the non-selected needles remain in the collecting track C.

At the start of zone U the previously unselected jacks are still at a common selection level. In zone U, the cams 27 and leading face(s) of the presser cams 29 ensure that the jacks are in the proper inactive pre-selection attitude. Then, in zone U, the appropriate faces 23*b* of the rockers 23, which have been sequentially lifted into the raised position as shown in FIG. 1, rock selected jacks 4 to lift their end parts 30 and place them in the active attitude. This situation remains unaltered whilst the jacks 4 pass through zone V.

In zone W, the jacks in the active attitude are raised for knitting tuck. As soon as they are raised, i.e. well before they have lifted any needle butts out of the collecting track, the end part 30 secures the jack in the active attitude so that the needle butt is ultimately securely lifted past the retracted cam 9 and placed at a tuck level. In zone X, the needle butts just lifted join the butts of needles which just passed over the clearing cam 11 and both sets of needles take the yarn fed. The needles 2 may rest upon the jacks 4 at this time so that the jacks 4 and cams 27 hold the needles at the level desired for taking the new yarn fed. Both sets of needles then meet the stitch cam 12 so that the butts 3 are clear of the cam face 9*c* and the downward movement of the needles is not used to lower the jacks 4 which thus are lowered by the cam 28 in zone Y, the cam 27 merely acting as a guard cam as this stage.

By merely shifting the cam 29 to the position shown in dotted lines, it is possible to perform a selection in the same manner in the opposite direction of traverse.

Operation for transfer sections

The lifting cam parts 27*b, c, d, e* can be selectively projected from outside the cam box to give the different operating modes for transfer.

For selective transferring in a trailing transfer system, a leading transfer selection cam 27*b* over one needle bed is projected whilst the loop reception cam 27*d* is projected towards the other needle bed. The rockers 23 on both parts of the cam carriage 4 are then selectively operated in the same manner to rock mutually aligned rocking jacks. As a consequence, the lifting butts 5 are moved out of the needle bed tricks and engage the cam 27*a*. The butts 5 of non-selected jacks 4 pass the cam 27*a* without being affected and the associated needles inactive.

The projected butts 5 of selected jacks rise on the cam 27*a* and are secured in the rocked position by the lobes 30. On one bed the butt 5 slides up a transfer selection cam 27*b* and in so doing lifts the needle operating butt 3 from a low track and places it on the side of a cam means 54 as shown by the position of the needles butt 2 illustrated in solid lines in FIG. 3. The other needle butts 3 stay down as shown in dotted lines and pass below the cam means 54.

The jacks 4 take no further part and are lowered to some extent by the trailing lowering cam 28 and remain in the rocked position in which they have been placed by the rocker 23 with their butts 5 just over the cam 27*a*.

The needle butts 3, which rise up the cam means 54, move into the leading recess 56 where a height control cam 58 is retracted. The butt 3 passes the midway position 10, spreading the loop to be transferred over a spreader which opens the loop on the needle. The butts 3 are then lifted to full transfer height by a projected trailing height control cam 58. At this stage the opposite needle effects a receiving motion under the influence of the projected loop reception cam 27*d*. All needles are then lowered.

The leading height control cam may, in an alternative construction, be projected so as to spread the loop more vigorously.

In a subsequent traverse no transfer may be necessary. The cams 27*b* to *e* are all retracted and the needle butts 3 will pass under the cam means 54. The jacks 4 will at last be lowered to selection height by the cam 28 on the trailing side of the transfer section B for a subsequent selection and knitting operation.

It is possible to rack the needle beds relatively at the end of the traverse and to cause the loops, previously transferred, to be transferred back to the original needle bed but on different needles for knitting cable-type patterns. This can be done by projecting the previously retracted needle height control cam 58, retracting the trailing and projecting cams 27*e* and 27*c* over the appropriate needle beds. The cam carriage will then automatically effect a transfer on the same needles whose jacks 4 have been left relatively high by the cam 28 with their butt 5 over the cam 27*a*, now on the leading side of the transfer section B.

It is also possible to select certain jacks 4, rock and lift them on the cam 27*a* without any of the cams 27*b* to *e* projected. The jacks 4 are left by the transfer system in a secure rocked attitude. During the subsequent cam carriage movement, a cam 27*b* and a cam 27*e* can be projected to effect a transfer between the needle beds with the transfer section in a leading position.

Only one set of rockers 23 controls leading and trailing selection and the number of traverses in which no knitting takes place and which are effected solely for the purpose of transfer can be reduced.

Non-selective transfer can be effected as explained previously by modifying the construction to include bolt cams 21, 22 to guide all needle butts 3 up the cam means 54 for transfer or an additional bolt cam for loop reception acting on the needle butts 3.

The loop transferring cam system of FIG. 3 can be modified as shown in dotted lines to provide a dual capability of transferring and/or knitting.

The cam means 54 is then subdivided in a fixed lower part 60 and a partly and wholly retractable upper part 62. In the knitting mode both cams 58 are retracted and inactive. When the part 62 is fully retracted, all needles engage the part 60 (after raising by means of jacks 4 and selection cams 27) will perform a knitting operation in either direction of cam carriage traverse. When the part 62 is halfway retracted, long butt needles will transfer and short butt needles will knit at the same time. Stitch cams 64 can be adjusted as shown by the arrows to vary the stitch length.

Coil-energisation

The coils of each solenoid 50 may be energized in accordance with information coded onto an 8 column punch tape which supplies signals to a memory store, which releases them to switch the coils in synchronisation with the traverse of the cam carriage. Non-selective knitting can be effected by inactivating all rockers 23. The coils need then not be energized as the armatures 52 are held in position by the associated permanent magnets. The solenoid may also be controlled by a suitable electronic programme on the basis of information entered from a key-board into a memory store in cooperation with a visual display unit.

Separate signals may be provided for movement of the rocker 23 to an active and to an inactive position so that the releasing time for one solenoid (de-energized as a result) overlaps with the energisation time of an other, oppositely acting coil.

With appropriate coil energisation, selected jacks are rocked and lifted, causing needles to be selected independently and in succession for knit and tuck at the leading knitting section A, for knit and tuck at the trailing knitting section A and for transfer in the appropriate mode at the trailing transfer section B.

Bolt or retractable cam operation

Retractable cams such as cams 9, 10 and the cams 58 may be operated by slides mechanically and automatically so as to ensure that the leading cam is always projected or retracted as required.

The aforementioned cams can be selectively and independently operated to project them simultaneously or one at a time in a manner similar to the other cams which are operated by a mechanism of the kind illustrated in FIG. 1 for a cam 27 of the transfer section B.

A solenoid 70 controls latches 72 engageable in recesses 74 in slidable bolts 76 carrying the respective cams. A spring 78 urges the cam 27 to its projected position. A slide 80 causes the bolt to be withdrawn at the end of a traverse of the cam carriage for re-latching by the latch 72. The cam can then be projected selectively by operating the solenoid 70. One slide may serve a number of bolts 76.

Description of another embodiment of invention

Figure 5:
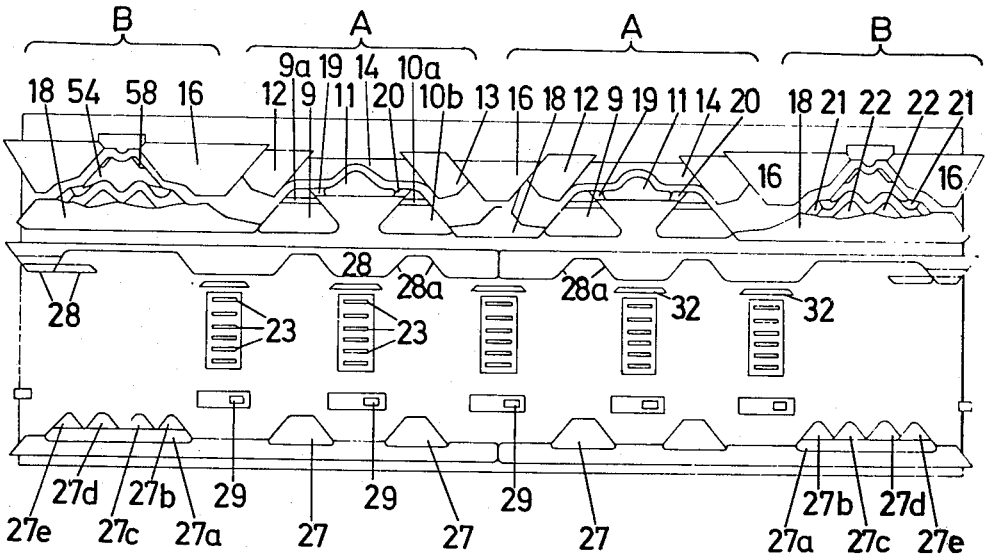
FIG. 5 shows an inside view of an overall cam system of another embodiment according to the invention.
Figure 6:
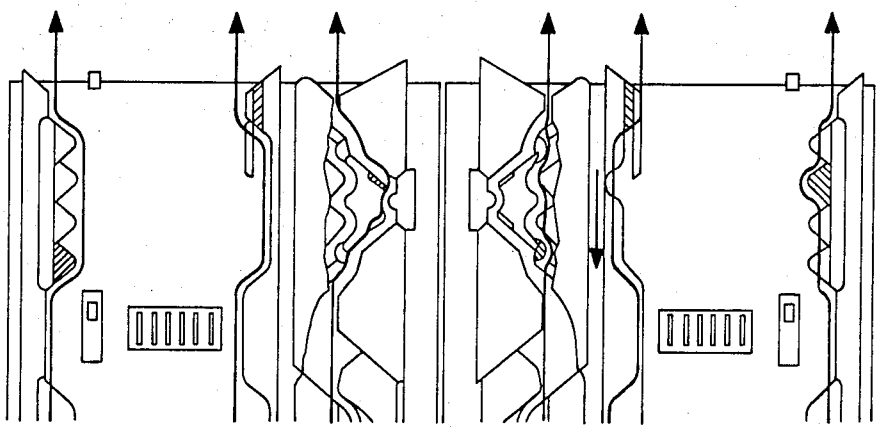
FIGS. 6 to 16 show different transfer modes of the cam system of FIG. 5.

With reference to FIG. 5, an alternative cam lay-out to that shown in FIGS. 2 and 3 employs similar needles 2, jacks 4 and actuator cams 23. The jack cam system is constructed analogously to that in FIGS. 2 and 3 and the same numerals have been employed. The needle butt cam system differs however in that cams 9 and 10 have fixed upper and lower portions **9*b* and 10*b* and retractable middle portions 9*a* and 10*a*, which are retracted at all times during selective knitting. Spring cams 19 and 20 are interposed between the clearing cam 11 and cams 9 and 10. The cams 19 and 20 are shaped so as to permit butts to push them inwards on upward movement to tuck level but to resist the butts and stay projected after they have moved down over the clearing cam 11**.

Cams **9*a*, and 10*a* are projected for non-selective knitting. The cams 9 and 10 then act as needle raising cams. The selective knitting operation is as described previously except that all jacks selected for knitting are lowered by cams 28*a*** and are left unselected during the subsequent selection for tucking.

The cams **28*a* act as guard cam to avoid overshooting of the jacks 4. The jacks 4 follow the profile of the cam 27 by means of their butts 5 whilst imparting concurrently the same motion to the needles 2. The upper cam portion of cams 9 and 10 take over from the cams 27 and the jacks 4** to lift the needle to tuck height.

Figure 7:
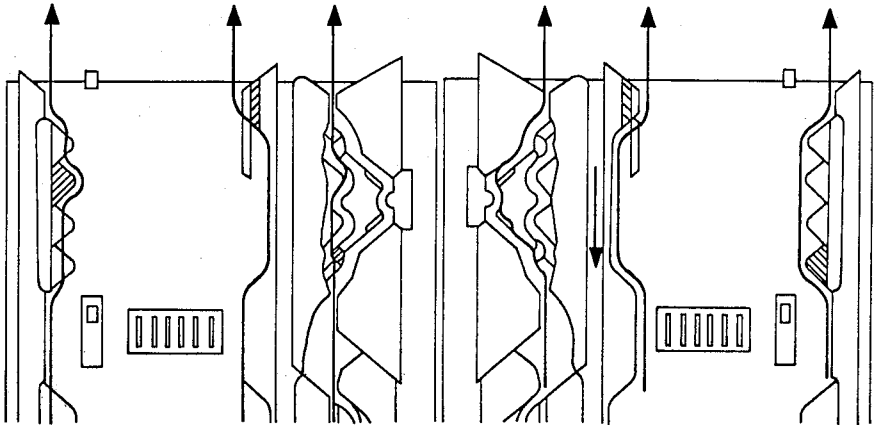
Figure 8:
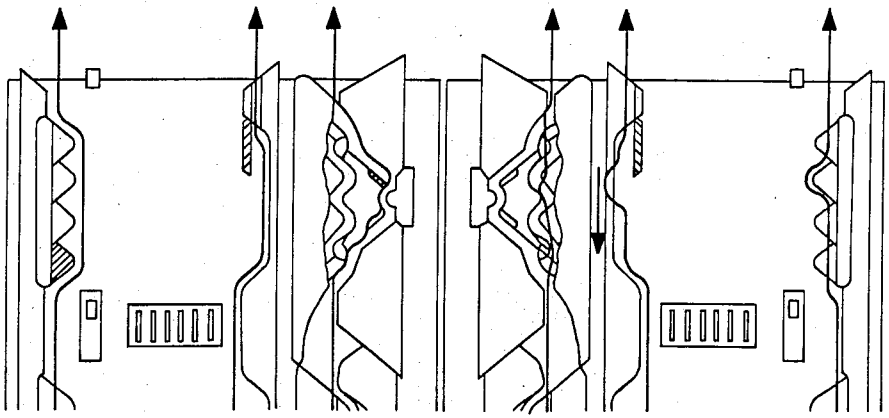
Figure 9:
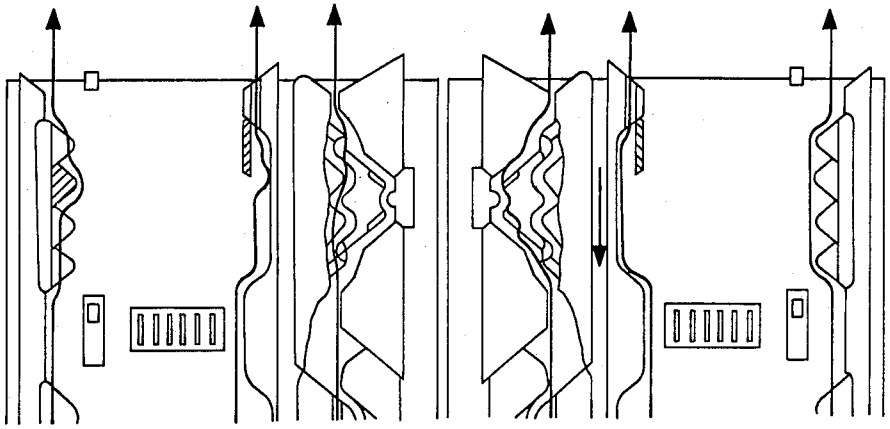
Figure 10:
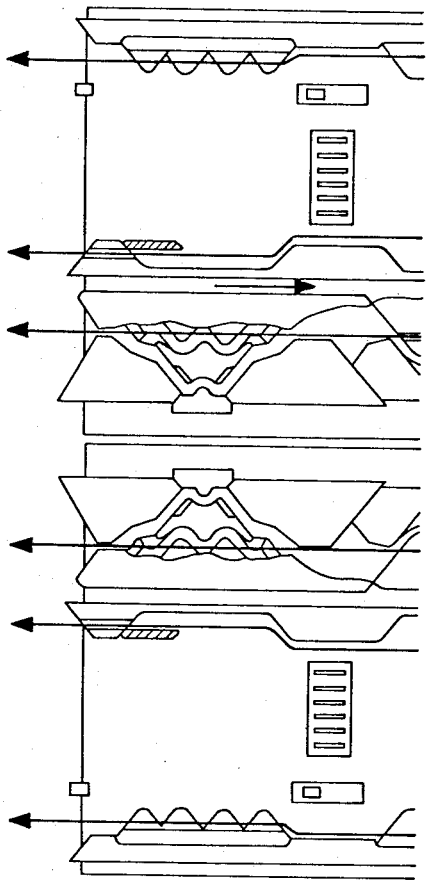
Figure 11:
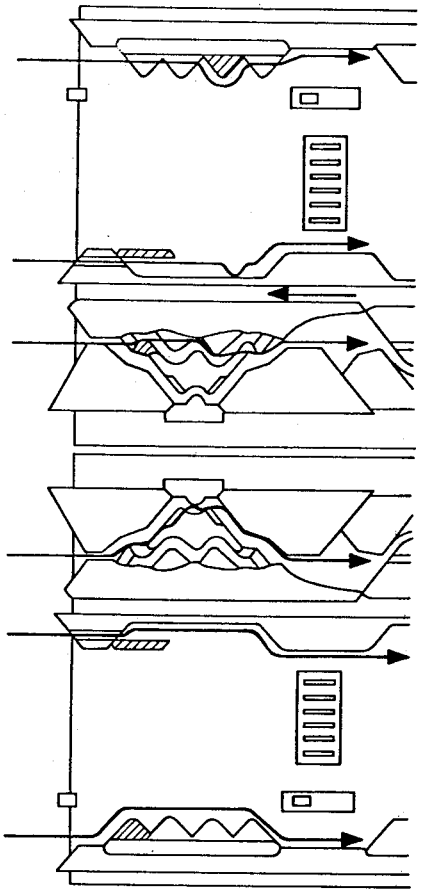
Figure 12:
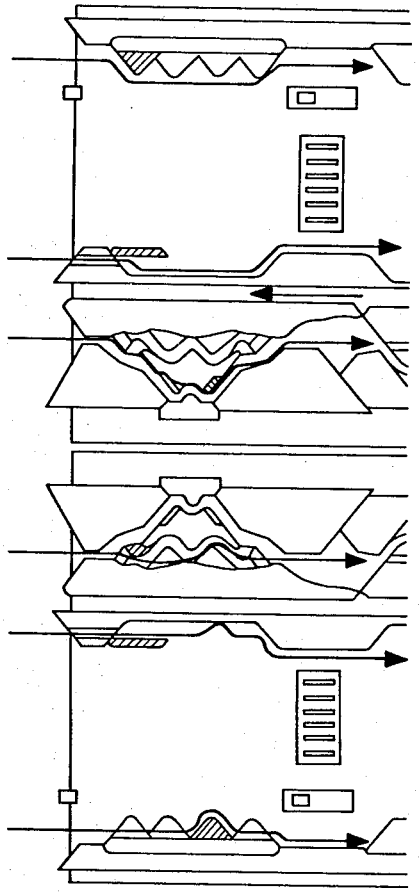
Figure 13:
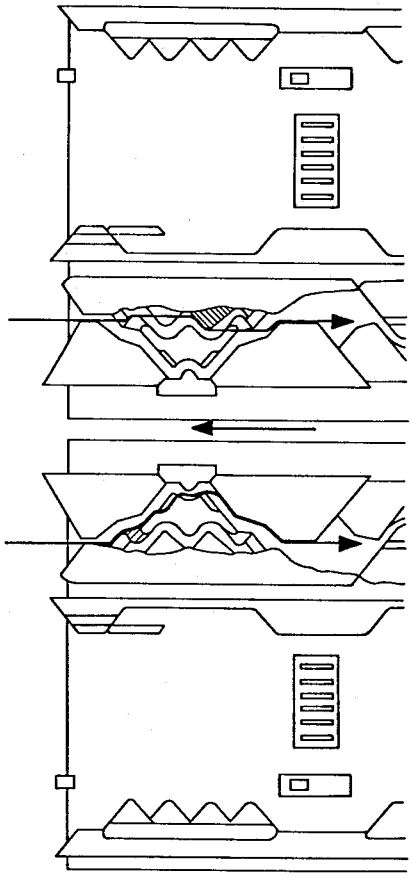
Figure 14:
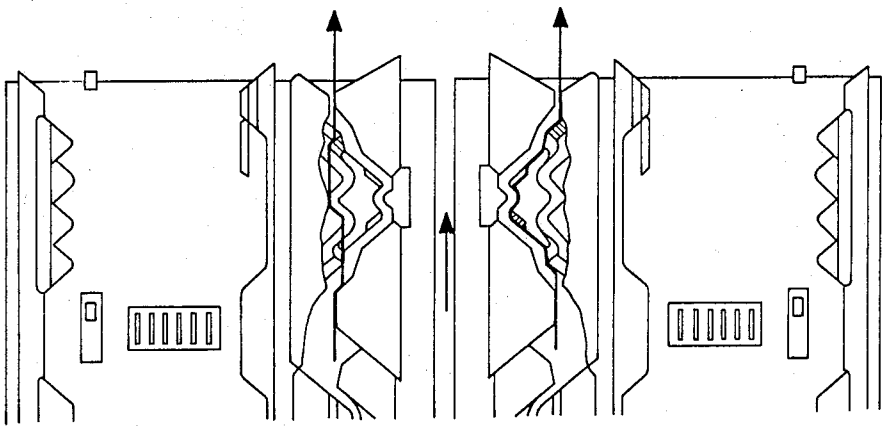
Figure 15:
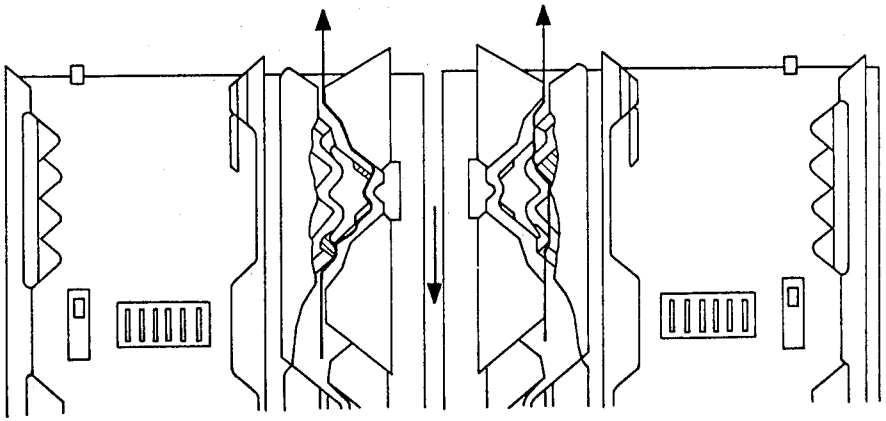
Figure 16:
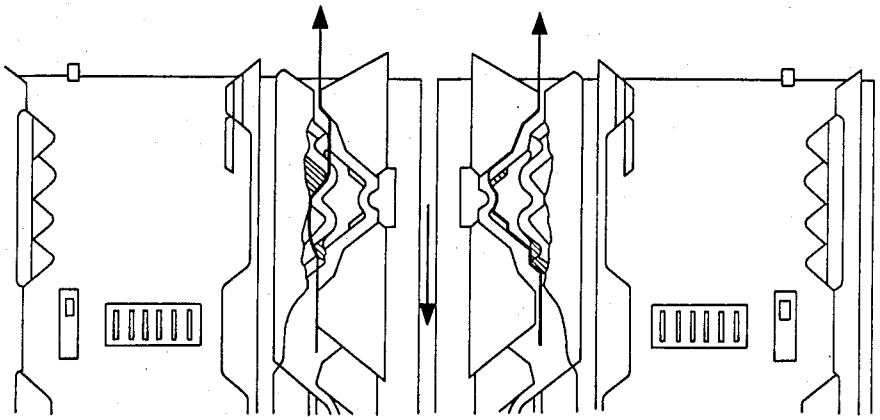

When transferring selectively, the trailing transfer section B can be appropriate cam projections shown in FIGS. 6 to 16 transfer from front to back (FIG. 6) and transfer back to front (FIG. 7). The projected bolt cams are shown in shaded lines. By resetting the cams **28*b* it is additionally possible to transfer from front to back (see FIG. 8) and leave the needles and jacks up ready for transfer by that transfer section B, which then becomes the leading one at the subsequent traverse as in FIG. 11 or 12. Similarly it is possible to transfer from back to front as in FIG. 9 and select for transfer at the subsequent traverse as in FIGS. 11 or 12. The two transfers follow immediately upon one another and would cancel each other out. This transfer sequence is thus used only with intervening racking, to provide successive transfers required for example in cable stitches. Selective transfer at a leading transfer system is possible by not transferring at one pass but merely by selecting first for transfer later at a subsequent traverse. Thus one can transfer at the leading transfer section (after selection at the preceding pass as in FIG. 10) from front to back (FIG. 11) and similar transfer from back to front (FIG. 12). The support surfaces at end parts 30** of the jack ensure that the jacks are kept in the rocked attitude after they have been lifted even after the cam carriage has moved past and are capable of performing reliably as selected when subjected to the transfer operation at the leading transfer station during a subsequent traverse.

When transferring non-selectively, the transfer section can be arranged (as in FIGS. 13 to 16) by inserting appropriate bolt cams to provide respectively front to back transfer at leading section; back to front transfer at leading section; front to back at trailing transfer section; and back to front transfer at the trailing transfer section.

In modified systems only one transfer system may be used or extra actuator banks could be incorporated to permit selection for the leading transfer system in the course of the same traverse as the one at which leading transfer is desired.

Advantages

The knitting sections permit independent selection of knit, tuck and float in either direction of traverse at both successive sections using a simple needle butt track arrangement. The knitting sections comprise few movable cams.

The transfer sections permit transfer at leading and trailing transfer sections in either direction of traverse from front to back or back to front. Using such transfer section traverses solely for transfer, at which no knitting takes place, can be avoided.

It is thus possible for a needle to transfer and subsequently knit or tuck.

The selection section comprises a plurality of actuator cams 23 which are operative in both directions of traverse so simplifying the patterning mechanism. The rocking jacks are arranged so as to avoid accidental, unintended selection of the needles. No separate pushing and rocking jacks are required and the associated cams are simple in construction.

The rocking jacks can be selected by a magnet arrangement which is simple and reliable in operation. The patterning instructions (punched tapes) necessary to control knitting can be easily prepared at reasonable cost. The cams of the knitting section are set the same for the different knit, tuck and float selections thus simplifying the selection at successive knitting sections and traverses.

Only one, main cam carriage may be used without requiring a separate transfer cam carriage and devices for coupling it to the main cam carriage.

The cams can be set to perform simple forms of knitting such as $1\times1$ or $2\times2$ rib, plain at front or back, or tube formation, without selection. The width and length of the patterned knitted area can be easily varied. 5-Colour jacquard patterns may be knitted. The use of a simple jack actuation system helps to reduce the length of the cam carriage, to reduce its length of travel and hence increase its working speed.

I claim:

1. Flat bed knitting machines having a pair of needle beds, tricks in said needle beds, needles and jacks in the respective tricks and having associated operating butts extending outwards of the tricks, said needle operating butts being non-rotatable, a cam carriage, means for sliding said cam carriage across said needle beds, cam means including clearing cam means and stitch cam means on said cam carriage defining for said needle operating butts in each direction of carriage movement a collecting track, a knitting track and a tucking track, a first bank of actuators for selectively engaging said jacks to cause selected needle operating butts to be raised lengthwise of the tricks from the collecting track for passing through the knitting track by means of said clearing cam means and said stitch cam means, a second bank of actuators spaced in trickwise alignment with said clearing cam means and housing on either side thereof cam means for raising the needle operating butts from the collecting track lengthwise of the tricks on the trailing side of said clearing cam means for passing through the tucking track by means of said stitch cam means in each direction of carriage movement.

2. Machine as claimed in claim 1 wherein the cam means include cams for raising jacks selected by said respective actuator banks and wherein the jacks are arranged in proximity to the needles to thereby raise the needle operating butts from the collecting track.

3. Machine as claimed in claim 1, wherein said cam means include retractable cams lying substantially against said clearing cam means, said retractable cams being projectable on the leading side of the clearing cam means to prevent undesired lowering of the needle operating butts yet permit raising of the needle operating butts on the trailing side of the clearing cam means.

4. Machine as claimed in claim 1 wherein said cam means includes non-rectractable raising cam means spaced from the clearing cam means to permit raising of the needle operating butts on the trailing side of the clearing cam means.

5. Machine as claimed in claim 1, wherein said cam means include presser cam means for ensuring that the jacks are in a common pre-selection attitude and cam means for locating the jacks at a particular position with respect to the tricks and wherein the jacks are rocking jacks which each have an integral pattern butt for operation by one of said actuator banks.

6. Machine as claimed in claim 5, wherein said presser cam means has a pair of oppositely inclined faces and slide means are provided for moving the presser cam upstream of the appropriate actuator bank in both directions of carriage movement.

7. Machine as claimed in claim 5, wherein the presser cam means has a pair of oppositely inclined faces and slide means are provided for moving the presser cam upstream of the appropriate actuator bank in both directions of carriage movement and wherein the presser cam means comprises a first element for initially pivoting the jacks at a position close to a pivot point of the jack and a second element at a position remote from said pivot point for accurately locating the jacks prior to selection.

8. Machine as claimed in claim 2, in which said cam means include cams for lowering the jacks which guide the jacks down in close proximity to the cams for raising the jacks.

9. Machine as claimed in claim 1 in which the jacks are rocking jacks and have a lower portion extending sideways toward the bottom of the trick to thereby secure the jacks in a jack raising cam engaging position when raised initially.

10. Machine as claim in claim 1 in which said cam carriage has a pair of adjacent knitting sections and the first actuator bank causes selected needle operating butts to be raised from the collecting track for knitting in each direction of cam carriage movement.

11. Machine as claimed in claim 1 in which said cam carriage has a transfer section next to a knitting section incorporating the aforesaid cam means and the first actuator bank causes selected needle operating butts to be raised from the collecting track for knitting by the knitting section in one direction of cam carriage movement and for transfer by the transfer section in the other direction of carriage movement.

12. Machine as claimed in claim 11, in which the jacks are rocking jacks and have a lower portion extending sideways towards the bottom of the trick to thereby secure the jacks in a jack raising cam engaging position once raised initially, and in which the transfer sections includes a jack lowering cam on the side of the transfer section opposite to the knitting section which lowers the jacks partly to thereby enable them to remain rocked after the cam carriage has moved passed and to take part in a transfer operation when the cam carriage returns.

13. Flat bed knitting machine having a pair of needle beds, tricks in said needle beds, needles and jacks in the respective tricks and associated with operating butts extending outwards of the tricks, a cam carriage, means for sliding the cam carriage across the needle beds, cam means including clearing cam means and stitch cam means for engaging the operating butts and an actuator bank for selecting the jacks as the carriage traverses across the needle beds, said jacks being rocking jacks and the actuator bank being arranged to rock the jacks for selection, said cam means providing a pair of cam slopes one on each side of the actuators to raise the jacks after selection, said needles being arranged close to the jacks so that the slopes lift the needles through the jacks, and said actuator bank being directly below said clearing cam means to enable needles to be lifted after selection by the actuator bank to the trailing side of the clearing cam means in both directions of cam carriage traverse for tucking by means of the stitch cam means.

14. Machine as claimed in claim 13 in which the jacks have integral pattern butts engageable by the actuator bank.

15. A machine according to claim 14 in which the jacks have a side ways extending parts at the lower end for holding the jacks rocked after initial lifting following selection.

16. Flat bed knitting machine having a pair of needle beds and a cam carriage with a knitting system and a transfer system, the transfer system including a raising cam acting on needle butts for successively spreading a loop and placing it at a transferring position in either direction of carriage traverse, a pair of retractable loop reception cams acting on jack butts placed at the transferring position and a pair of transfer selector cams one on either side of the pair of retractable reception cams for causing a needle to move in a transferring or receiving mode under control of the raising cam or the appropriate loop reception cam.

17. Flat bed knitting machine according to claim 16 in which a jack lifting cam is provided to impart initial lift to selected jacks so as to hold the jacks in a rocked attitude once lifted initially for operation by the loop reception or transfer selection cams during leading or trailing transfer.

18. Flat bed knitting machine according to claim 16 in which a cam is provided to locate the initially lifted jacks at a level suitable for engaging the transfer selection or loop reception cams on the leading side of the transfer system during leading transfer or receipt.

19. Flat bed knitting machine according to claim 16 in which the actuator is arranged to serve for selection for the knitting system on the leading side of the knitting system after the jacks have passed through the transfer system.

20. Flat bed knitting machine according to claim 16 in which each jack has a lower lifting butt for engaging the jack lifting cam and the receiving and selector cams, an upper butt for engaging the jack height control cams, pattern butts on an upper arm of the jack for operation by the actuator, and a presser butt on the lower arm of the jack for returning the jacks to a pre-selection position, the projection being in the form of a lobe on the lower extremity of the jacks.

21. Flat bed knitting machine according to claim 16 in which the raising cam has retractable cam portions for controlling the height to which needles are lifted so as to vary the extent of loop spreading without influencing the transferring position.

22. Flat bed knitting machine according to claim 16 in which the transferring cam has a retractable upper portion for defining a knitting track and stitch cams are mounted on either side of the transferring cam.

23. Flat bed knitting machine having a pair of needle beds and a cam carriage with a knitting system and a transfer system, the transfer system including a raising cam acting on needle butts for successively spreading a loop and placing it at a transferring position in either direction of carriage traverse, a pair of retractable loop reception cams for raising needles to receive loops, in which the raising cam has inclined sides and retractable cam portions are located against the sides to enable loops to spread when the cam portion is withdrawn in a leading position and to be transferred by the cam portion in the trailing position, whilst needle butts can be raised and lowered by other cam fixed portions between said retractable cams.

24. Flat bed knitting machine according to claim 23, in which the loop reception cam has a reduced slope part for steadying the needle for latch opening by the yarn on the needle raised by the raising cam.

25. Flat bed knitting machine according to either of claims 23 or 24, in which part of the raising cam between retractable portions is itself retractable to enable knitting to be performed on the transfer system, the inside of the retractable cam portions serving to initially lower needle operating butts.

* * * * *